US006116934A

United States Patent [19]

Longueville

[11] Patent Number: 6,116,934

[45] Date of Patent: Sep. 12, 2000

[54] PCB ZERO-INSERTION-FORCE CONNECTOR

[75] Inventor: Jacques Longueville, Oostkamp, Belgium

[73] Assignee: Siemens Aktiengesellschaft, Munich, Germany

[21] Appl. No.: 09/460,348

[22] Filed: Dec. 13, 1998

Related U.S. Application Data

[63] Continuation of application No. PCT/DE98/01388, May 20, 1998.

[30] Foreign Application Priority Data

Jun. 13, 1997 [DE] Germany ..... 197 25 132

[51] Int. Cl.[7] ..... H01R 13/15; H01R 13/64; H01R 12/00

[52] U.S. Cl. ..... 439/260; 439/377

[58] Field of Search ..... 439/260, 259, 439/267, 261, 377, 64, 327, 328

[56] References Cited

U.S. PATENT DOCUMENTS

| | | | |
|---|---|---|---|
| 3,130,351 | 4/1964 | Giel | 317/101 |
| 3,853,379 | 12/1974 | Goodman et al. . | |
| 4,047,782 | 9/1977 | Yeager . | |
| 4,392,705 | 7/1983 | Andrews, Jr. et al. | 439/342 |
| 4,544,223 | 10/1985 | Gillett . | |
| 4,705,338 | 11/1987 | Sitzler | 439/260 |
| 4,804,334 | 2/1989 | Alexeenko et al. | 439/260 |
| 4,863,395 | 9/1989 | Babuka et al. | 439/260 |
| 5,052,936 | 10/1991 | Biechler et al. | 439/60 |
| 5,171,154 | 12/1992 | Casciotti et al. | 439/67 |
| 5,216,578 | 6/1993 | Zenitani et al. | 361/690 |
| 5,938,453 | 8/1999 | Ichimura | 439/67 |
| 5,975,934 | 11/1999 | Ichimura | 439/260 |

*Primary Examiner*—Gary F. Paumen
*Assistant Examiner*—Edwin A. León
*Attorney, Agent, or Firm*—Herbert L. Lerner; Laurence A. Greenberg; Werner H. Stemer

[57] ABSTRACT

The PCB zero-insertion-force connector assembly has an actuating element. Upon the actuation of the actuating element, a PCB zero-insertion-force connector (1; 11–14) can be moved from a mounting position, allowing the insertion or removal of a PCB, into a connecting position, properly establishing the contact of the PCB, and vice versa. The actuating element of the novel PCB zero-insertion-force connector is integrated into a PCB guiding device, with the aid of which the PCB to be brought into connection with the PCB zero-insertion-force connector or already connected to the latter can be guided toward or away from the latter.

6 Claims, 3 Drawing Sheets

PCB ZERO-INSERTION-FORCE CONNECTOR

CROSS-REFERENCE TO RELATED APPLICATION

This is a continuation of copending International Application PCT/DE98/01388, filed May 20, 1998, which designated the United States.

BACKGROUND OF THE INVENTION

Field of the Invention

The present invention relates to circuit board connectors and, more specifically, to a PCB zero-insertion-force connector with an actuating element, by the actuation of which the PCB zero-insertion-force connector can be brought from a mounting position, allowing the insertion or removal of a PCB, into a connecting position, properly establishing the contact of the PCB, and/or vice versa.

PCB zero-insertion-force connectors connect two PCBs electrically and mechanically to each other essentially without any force; they are used, inter alia, for the purpose of being able to fit a first PCB in a simple and undamaging manner essentially perpendicularly onto a second PCB (for example a so-called backplane) and thereby connect it electrically and mechanically to the latter in a secure and reliable manner.

PCB zero-insertion-force connectors have long been known in a large number of embodiments; a PCB zero-insertion-force connector of the above type is described, for example, in U.S. Pat. No. 3,130,351.

The PCB zero-insertion-force connector known from the prior patent is mounted securely on one of the PCBs to be brought into connection with each other and is designed in such a way that the other of the PCBs to be brought into connection with each other can be inserted into it. It is constructed in such a way that, by the actuation of an actuating element, it can be brought into a mounting position, allowing the insertion or removal of a PCB, and, by the insertion of a PCB, can be brought into the connecting position. The actuating element is a rod which runs parallel alongside a PCB guiding device and with the aid of which the PCB to be brought into connection with the PCB zero-insertion-force connector or already connected to the latter can be guided toward or away from the latter. In order for it to fulfil its purpose, the rod must protrude beyond the PCB inserted into the PCB zero-insertion-force connector, to be more precise beyond the rear edge of the same with respect to the direction of insertion, to such an extent that the rod is always freely accessible and actuable. For this reason, it must be of a considerable length, which makes it susceptible to damage and deformation. In order to reliably rule out damage and deformation to the rod, the same could be designed to be correspondingly stable. However, this would make the assembly disproportionately expensive and unwieldy.

SUMMARY OF THE INVENTION

It is accordingly an object of the invention to provide a PCB zero-insertion-force connector, which overcomes the above-mentioned disadvantages of the heretofore-known devices and methods of this general type and the actuating element of which is reliably protected against damage and deformation under any circumstances, even with a mechanically relatively weak design of the same.

With the foregoing and other objects in view there is provided, in accordance with the invention, a PCB zero-insertion-force connector assembly, comprising:

a PCB zero-insertion-force connector adapted to selectively assume a mounting position, allowing the insertion or removal of a PCB, and a connecting position, properly establishing contact of a PCB;

a PCB guiding device for guiding a PCB towards and away from the PCB zero-insertion-force connector;

an actuating element integrated in the PCB guiding device and adapted to move the PCB zero-insertion-force connector from the mounting position into the connecting position and vice versa.

In other words, the objects of the invention are satisfied with the integration of the actuating element into a PCB guiding device, with the aid of which the PCB to be brought into connection with the PCB zero-insertion-force connector or already connected to the latter can be guided toward or away from the latter.

As a result, the actuating element can be guided in a manner in which it bears directly against parts of the PCB guiding device and/or the PCB. This has the effect that the actuating element on the one hand offers a smaller area over which external forces can act on it, and on the other hand is laterally protected by the PCB guiding device and/or the PCB.

The integration of the actuating element into the PCB guiding device additionally has the positive effect that the actuating element reaches the (swivel) mechanism of the PCB zero-insertion-force connector, which is required to bring the PCB zero-insertion-force connector out of the mounting position into the connecting position and/or vice versa, at a centrally situated location. This allows the mechanism to be symmetrically designed. A symmetrical construction of the swivel mechanism makes it possible for the forces exerted by the latter on the actuating element to be partially cancelled out and/or for asymmetrical loading of the actuating element to be avoided, as a result of which the forces acting on the actuating element, or at least their negative side effects, can be reduced to a minimum.

The actuating element of the PCB zero-insertion-force connector according to the invention is therefore reliably protected against damage and deformation, even when the element is configured relatively weak in a structural mechanical sense.

This applies to a particular extent, but obviously not exclusively, whenever the actuating element runs between the PCB guiding device and the PCB.

Independently of this, on account of its integration into the PCB guiding device, which is normally present in any case, the actuating element designed and arranged as claimed no longer represents an obstacle to the air flow for cooling the PCBs, as it did before. In particular in the case of PCBs fitted onto backplanes, this is of considerable significance, since the fitted-on PCBs are in some cases so close together there that adequate cooling in any case becomes increasingly complicated and difficult.

In the case of a symmetrical construction of the swivel mechanism of the PCB zero-insertion-force connector, both the production and the installation of the PCB zero-insertion-force connector can be simplified and standardized considerably.

In accordance with an added feature of the invention, the actuating element is essentially completely integrated in the PCB guiding device.

In accordance with an additional feature of the invention, the actuating element is a longitudinally displaceable rod-like element.

In accordance with another feature of the invention, the actuating element is integrated into the PCB guiding device in a manner in which is is laterally supported by the PCB guiding device.

In accordance with a further feature of the invention, the actuating element is integrated into the PCB guiding device such that the actuating element is additionally supported by a PCB guided by the PCB guiding device.

In accordance with again a further feature of the invention, the PCB is guided in a groove defined by the actuating element.

In accordance with a concomitant feature of the invention, the PCB zero-insertion-force connector is actuated by a swivel mechanism which, in turn, is actuated by the actuating element. In accordance with this feature, the actuating element is detached from the swivel mechanism in at least either the mounting position or the connecting position.

Other features which are considered as characteristic for the invention are set forth in the appended claims.

Although the invention is illustrated and described herein as embodied in a PCB zero-insertion-force connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

The PCB zero-insertion-force connector described in more detail below is designed for the purpose of connecting electrically and mechanically to each other two PCBs which are to be arranged essentially perpendicularly with respect to each other (to be fitted perpendicularly one onto the other). However, use of the PCB zero-insertion-force connector according to the invention is not restricted to such applications; the PCBs which can be connected by PCB zero-insertion-force connectors of the type described can in principle assume any desired relative positions.

Figure 1:
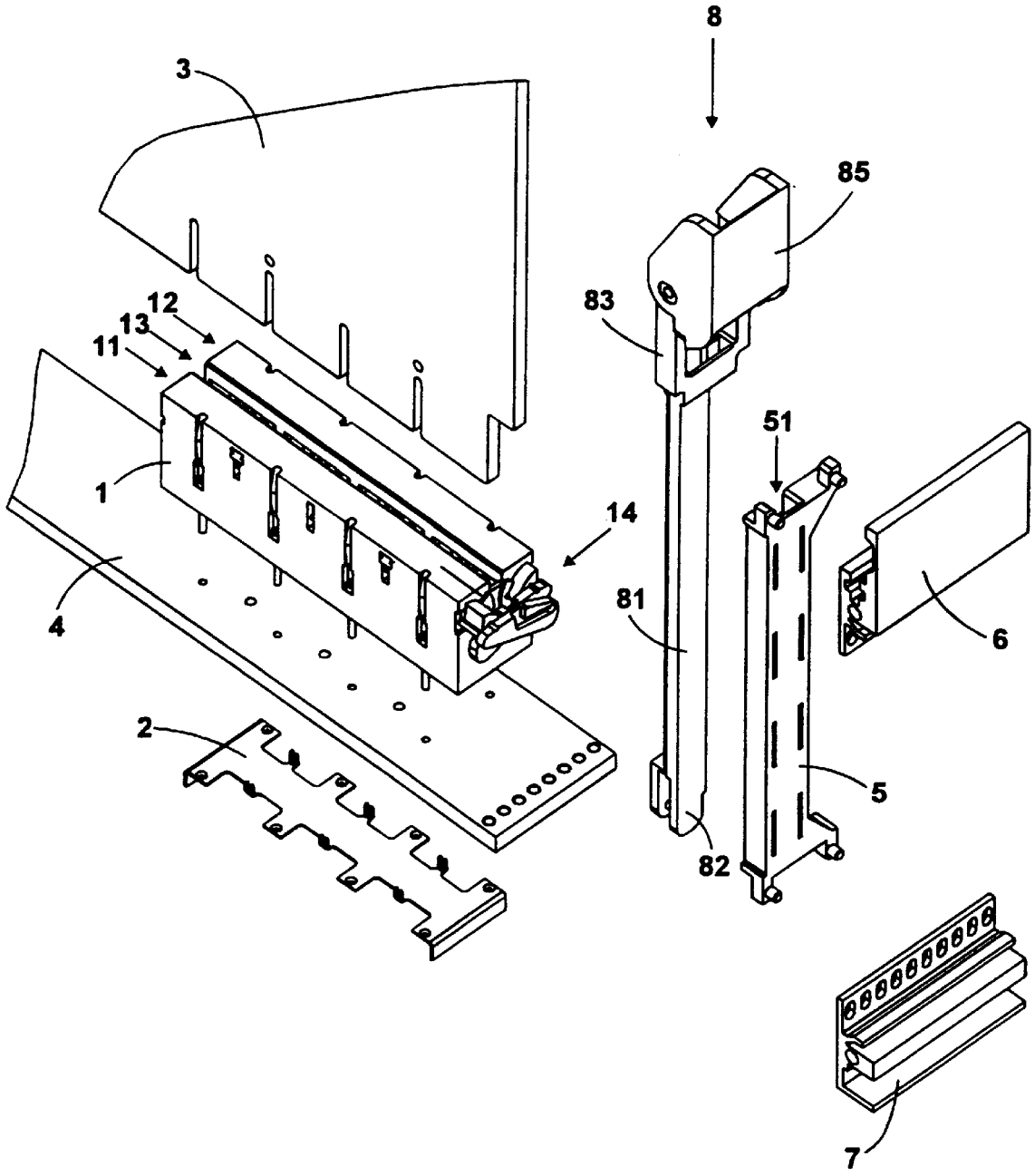
FIG. 1 is an exploded perspective view of an assembly containing the PCB zero-insertion-force connector according to the invention.

Referring now to the figures of the drawing in detail and first, particularly, to FIG. 1 thereof, there is seen a PCB zero-insertion-force connector 1. The PCBs which are to be connected by this PCB zero-insertion-force connector 1 are a first PCB 3 and a second PCB 4. The intention is thereby to plug the first PCB 3 essentially perpendicularly onto the second PCB 4. PCBs of the type of the second PCB 4 are, for example, the so-called backplanes; the PCBs which can be plugged onto the latter, of the type of the first PCB 3 are frequently referred to as insert cards, corresponding to the way in which they are mounted.

The PCB zero-insertion-force connector 1 is securely mounted on the second PCB 4 with the aid of a mounting plate 2. In this arrangement, the PCB zero-insertion-force connector 1 and the second PCB 4 are securely and reliably connected to each other both mechanically and electrically.

The PCB zero-insertion-force connector 1 has in its interior two connector halves 11 and 12 (hidden in the figures), which are separated from each other by an elongate slot 13. The first connector half 11 and the second connector half 12 can be swiveled or swung toward each other and away from each other (even in the state in which the PCB zero-insertion-force connector 1 is mounted on the second PCB 4) by the actuation of a swivel mechanism 14 which is provided laterally on the PCB zero-insertion-force connector 1 but is not described in any more detail here.

When the connector halves 11 and 12 are swiveled apart the latter move away from each other at the upper end of the PCB zero-insertion-force connector 1, according to the representation in FIG. 1. As a result, the slot 13 widens. If and for as long as the slot 13 is widened, a first PCB 3 can be inserted into the latter. This position of the PCB zero-insertion-force connector 1 is therefore referred to as its mounting position.

The swiveling together of the connector halves 11 and 12 has the effect that the latter move toward each other at the upper end of the PCB zero-insertion-force connector 1, according to the representation in FIG. 1, whereby the slot 13 becomes narrower. If and for as long as the slot is constricted in this way, the first PCB 3 possibly inserted therein is clamped in more or less securely there and therefore comes into connection with the second PCB 4 electrically and mechanically via the PCB zero-insertion-force connector 1; the electrical connection between the PCB zero-insertion-force connector 1 and the first PCB 3 is in this case accomplished by pressing contact springs (not shown in the figures) of the PCB zero-insertion-force connector 1 that can be swiveled together with the connector halves 11 and 12 against surface contacts (likewise not shown in the figures) of the first PCB 3.

Provided on two opposite sides of the PCB zero-insertion-force connector 1 are PCB guiding devices 5, with the aid of which (between which) the first PCB 3 can be guided in a defined manner in or out of the slot 13 of the PCB zero-insertion-force connector 1; only one of the PCB guiding devices 5 is shown in the figures. This PCB guiding device, denoted by the reference numeral 5, can be mounted by means of mounting plates 6 and 7 on the housing or frame accommodating the arrangement shown, neither the housing nor the frame being shown in the figures.

In the PCB guiding device 5 there is fitted in the region facing the first PCB 3, to be guided by said device, an element referred to as an actuating element 8, which serves simultaneously as a guiding element of the PCB guiding device 5 and as an actuating element for actuating the swivel mechanism 14 of the PCB zero-insertion-force connector 1; although this is not the case in the example considered here, each of the PCB guiding devices may be equipped with such a or a similar actuating element 8.

The actuating element 8 is an essentially rod-like element (a pushing and pulling rod), which has an essentially U-shaped cross section in the middle part 81, i.e. outside its two end portions 82 and 83. The middle part 81 is dimensioned such that it can be inserted into the PCB guiding device 5, to be more precise a free space 51 of the same provided for this purpose, in such a way that, although the actuating element 8 is freely displaceable in the longitudinal direction of the same, it otherwise has relatively little freedom to move within the PCB guiding device 5; the PCB guiding device 5 and/or the actuating element 8 and/or the mounting plates 6, 7 are designed in such a way that the actuating element 8 is or can be secured against falling out and/or being pulled out from the PCB guiding device 5.

Figure 2:
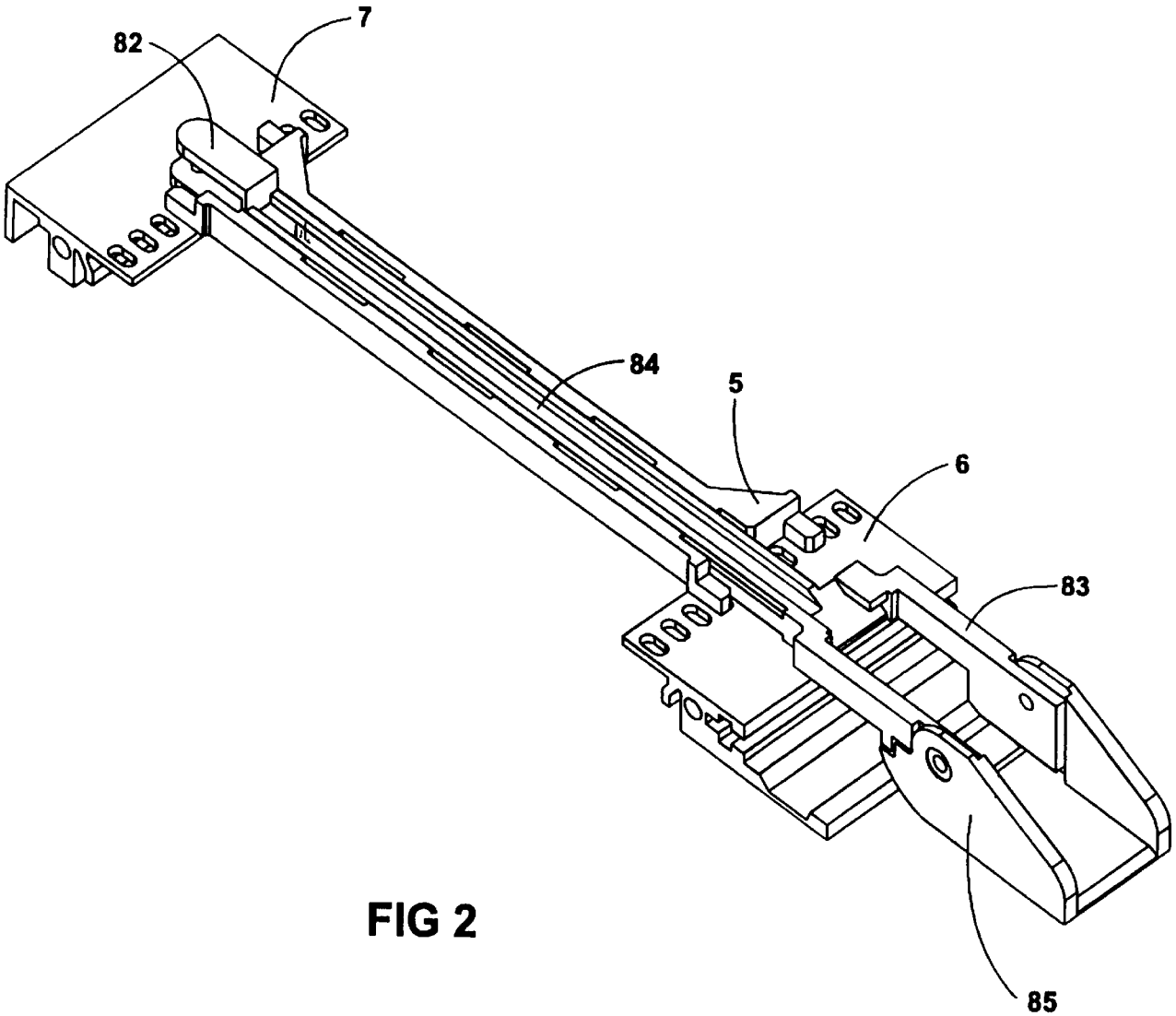
FIG. 2 is a perspective view of the PCB guiding device containing the actuating element.
Figure 3:
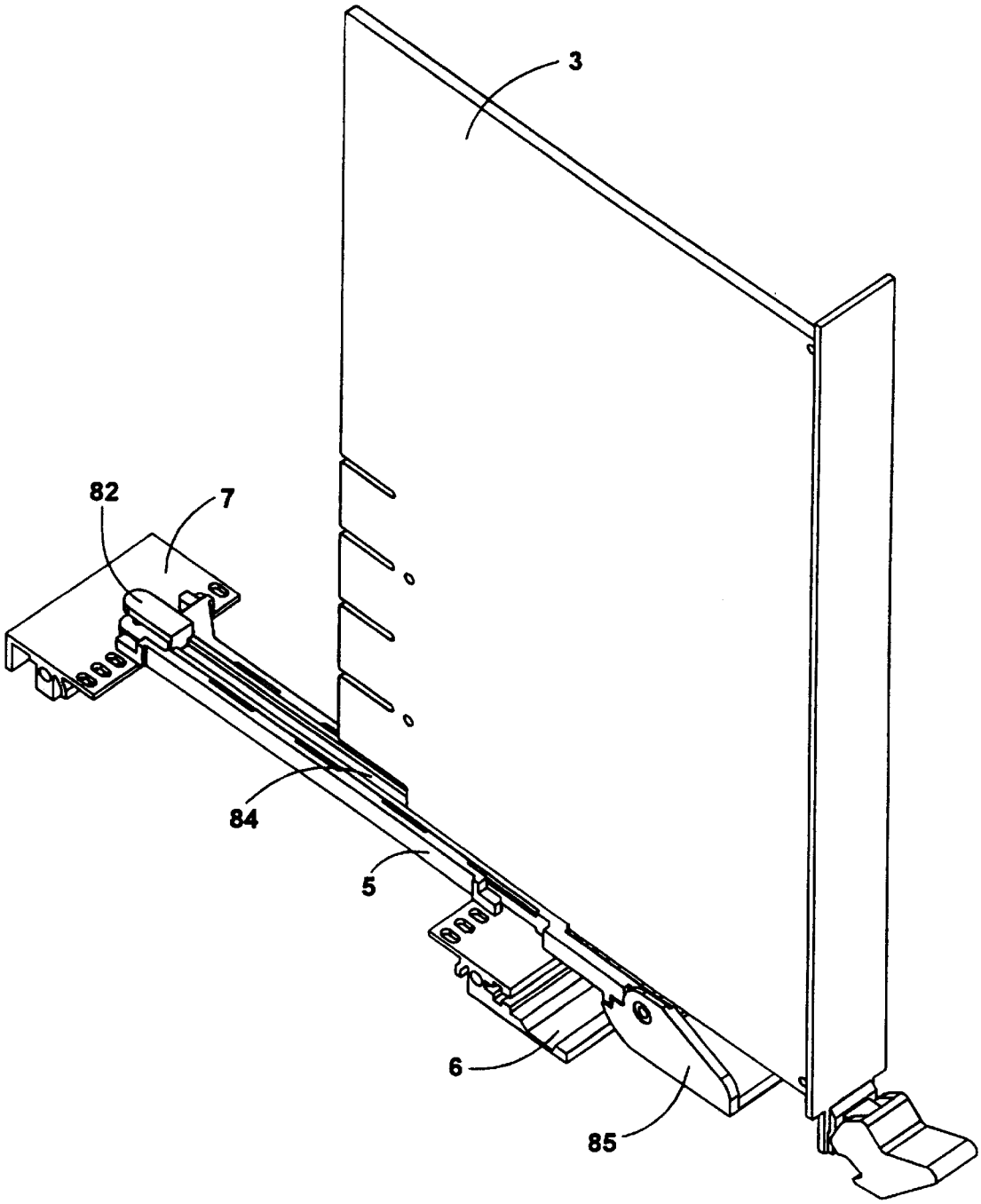
FIG. 3 is a perspective view of the PCB guiding device according to FIG. 2 with the PCB partially inserted.

In the state of the actuating element 8 in which it is inserted into the PCB guiding device 5, as can be seen in particular from FIGS. 2 and 3 there is defined by said element on the side of the PCB guiding device 5 facing the PCB to be guided a groove-like clearance 84, in which the first PCB 3, to be guided by the guiding device 5, can be guided in the way illustrated in FIG. 3. As a result, the actuating element 8 acts as a guiding element of the PCB guiding device 5.

The end portion facing the PCB zero-insertion-force connector 1 in the assembled state, i.e. the end portion of the actuating element 8 denoted by the reference numeral 82, comes into engagement with the swivel mechanism 14 during use as intended, in such a way that the swinging open and closed of the connector halves 11 and 12 of the PCB zero-insertion-force connector 1 is brought about by an actuation, i.e. a movement of the actuating element 8 in the longitudinal direction. The engagement between the end portion 82 of the actuating element 8 and the swivel mechanism 14 is arranged in such a way that these elements are not in connection with each other (released from each other), at least either in the mounting position or in the connecting position of the PCB zero-insertion-force connector 1; as a result, the actuating element 8 can be inserted into the arrangement or removed from it together with the PCB guiding device 5, or without it, at any points in time, entirely independently of the PCB zero-insertion-force connector 1.

The end portion facing away from the PCB zero-insertion-force connector 1 in the assembled state, i.e. the end portion of the actuating element 8 denoted by the reference numeral 83, protrudes beyond a PCB inserted into the PCB zero-insertion-force connector 1, to be more precise beyond the rear edge of said PCB with respect to the direction of insertion, and is provided in the example considered with a hinged part 85 resembling a two-armed lever. This hinged part 85, which is not described in any more detail here, serves the purpose of facilitating the displacement of the actuating element 8 in the longitudinal direction of the latter and/or of coordinating it with the insertion/removal of a PCB (of the PCB 3). However, the displacing of the actuating element 8 can also be carried out without the assistance of the hinged part 85 or the like.

The displacing of the actuating element 8, i.e. the pushing or pressing of the same toward the PCB zero-insertion-force connector 1 or the pulling away of the same from the PCB zero-insertion-force connector 1, must be carried out if the PCB zero-insertion-force connector 1 is to be brought from the mounting position into the connecting position or vice versa.

If and for as long as the actuating element 8 is in a position in which it is pulled away (detached) from the PCB zero-insertion-force connector, the PCB zero-insertion-force connector 1 occupies the mounting position. In this position, a PCB can be inserted under guidance by the PCB guiding devices 5 essentially without any force between the swung-open connector halves 11 and 12 of the PCB zero-insertion-force connector 1.

During subsequent pressing in of the actuating element 8 toward the PCB zero-insertion-force connector 1, said element comes into engagement by its end portion 82 with the swivel mechanism 14 and has the effect as a result that the PCB zero-insertion-force connector 1, which is located in the mounting position, is brought into the connecting position. The connector halves 11 and 12 of the PCB zero-insertion-force connector 1 thereby swing together and clamp between them the PCB inserted between them, whereby a secure and reliable electrical and mechanical connection with the inserted PCB is established.

For removing the PCB from the PCB zero-insertion-force connector 1, the actuating element 8 must be pulled away from the latter. As a result, the swivel mechanism 14 is actuated in such a way that it brings the PCB zero-insertion-force connector 1 from the connecting position into the mounting position. That is to say, the connector halves 11 and 12 of the PCB zero-insertion-force connector 1 swung together in the connecting position of the latter swing open and make it possible for the PCB inserted into the PCB zero-insertion-force connector 1 to be removed from the same essentially without any force.

The displacing of the actuating element 8 by pressing and pulling it represents enormous mechanical loading for it. However, this loading has no adverse effects on the actuating element 8 in this case, since here it is integrated in the PCB guiding device 5 and is laterally protected by the latter without hindering the displaceability in the longitudinal direction.

It proves to be particularly advantageous for the actuating element 8 to thereby be additionally supported by the PCB respectively guided by the PCB guiding device 5. The additional supporting of the actuating element by the PCB is not absolutely necessary, however; the actuating element may also be integrated into the guiding device 5 so comprehensively (supported on all sides or on a number of sides) that it does not need the mentioned additional support by the PCB.

The fact that the actuating element 8 is laterally supported over almost its entire length and on a number of sides or all sides prevents the possibility of the element being bent or buckled by the displacement or other external influences. This effect is achieved even when the actuating element 8 is of a mechanically relatively weak design.

Added to this is the fact that the described design and arrangement of the actuating element 8 offers the possibility of keeping the forces acting on it, or their adverse effect, extremely small.

This is because the integration of the actuating element 8 into the PCB guiding device 5 has the positive effect that the actuating element 8 can reach the swivel mechanism 14 at a centrally situated location, as a result of which the latter can be symmetrically designed. A symmetrical construction of the swivel mechanism makes it possible for the forces exerted by the latter on the actuating element, in particular the forces acting transversely to the direction of displacement of the actuating element 8, to be partially cancelled out by one other and/or for asymmetrical loading of the actuating element to be avoided, as a result of which the forces acting on the actuating element, or at least their negative side effects, can be reduced to a minimum.

The integration of the actuating element 8 into the PCB guiding device 5 additionally has the positive effect that the actuating element 8 can be accommodated in a space-saving manner (the PCB guiding device 5 does not have to be designed to be any larger, or at most insignificantly larger, than before) and does not represent an obstacle to the through-ventilation (cooling) or reduction in size of the arrangement.

In summary, despite its simplified construction, the novel PCB zero-insertion-force connector according to the invention is distinctly superior to the conventional PCB zero-insertion-force connectors in a number of respects.

I claim:

1. A PCB zero-insertion-force connector assembly, comprising:

a PCB zero-insertion-force connector adapted to selectively assume a mounting position, allowing the insertion or removal of a PCB, and a connecting position, properly establishing contact of a with the PCB;

a PCB guiding device for guiding the PCB towards and away from said PCB zero-insertion-force connector;

an actuating element integrated in said PCB guiding device and adapted to move said PCB zero-insertion-force connector from the mounting position into the connecting position and vice versa.

2. The PCB zero-insertion-force connector assembly according to claim 1, wherein said actuating element is essentially completely integrated in said PCB guiding device.

3. The PCB zero-insertion-force connector assembly according to claim 1, wherein said actuating element is a longitudinally displaceable rod-like element.

4. The PCB zero-insertion-force connector assembly according to claim 1, wherein said actuating element is integrated into said PCB guiding device to be laterally supported by said PCB guiding device.

5. The PCB zero-insertion-force connector assembly according to claim 4, wherein the PCB is guided in a groove defined by said actuating element.

6. The PCB zero-insertion-force connector assembly according to claim 1, which further comprises a swivel mechanism actuated by said actuating element and wherein, in at least one of the mounting and connecting positions, said actuating element is detached from said swivel mechanism.

* * * * *